US010561895B1

(12) United States Patent
Lee

(10) Patent No.: US 10,561,895 B1
(45) Date of Patent: Feb. 18, 2020

(54) BALANCE BOARD

(71) Applicant: Gavin Lee, El Cerrito, CA (US)

(72) Inventor: Gavin Lee, El Cerrito, CA (US)

( * ) Notice: Subject to any disclaimer, the term of this patent is extended or adjusted under 35 U.S.C. 154(b) by 156 days.

(21) Appl. No.: 15/470,474

(22) Filed: Mar. 27, 2017

Related U.S. Application Data

(60) Provisional application No. 62/313,857, filed on Mar. 28, 2016.

(51) Int. Cl.
*A63B 22/16* (2006.01)
*A63B 26/00* (2006.01)

(52) U.S. Cl.
CPC ..... *A63B 22/16* (2013.01); *A63B 26/003* (2013.01)

(58) Field of Classification Search
CPC ..... A63B 22/14–18; A63B 21/4049; A63B 26/003; A63B 2026/006; A63B 22/16
See application file for complete search history.

(56) References Cited

U.S. PATENT DOCUMENTS 3,352,559 A * 11/1967 Larsen ..... A63B 69/3667 473/269
3,488,049 A * 1/1970 Sasser, Jr. ..... A63B 22/16 482/146
3,604,726 A * 9/1971 Tracy ..... A63B 21/0004 280/205
3,730,521 A * 5/1973 Sellman ..... A63B 22/14 482/147
3,806,116 A * 4/1974 Malmberg ..... A63B 22/14 482/147
3,984,100 A 10/1976 Firster
4,026,279 A * 5/1977 Simjian ..... A61H 15/00 482/147
4,252,312 A * 2/1981 Dehan ..... A63B 22/18 482/146
4,291,873 A * 9/1981 Lee ..... A63B 22/14 482/147
4,391,441 A * 7/1983 Simjian ..... A63B 22/14 482/131
4,491,318 A * 1/1985 Francke ..... A63B 21/0004 482/147
4,787,630 A * 11/1988 Watson ..... A63B 22/14 482/146
5,203,279 A * 4/1993 Eversdyk ..... A01K 15/027 119/702
5,292,296 A 3/1994 Davignon
5,320,594 A * 6/1994 Huang ..... A63B 22/14 482/147

(Continued)

OTHER PUBLICATIONS

Copending U.S. Appl. No. 15/480,368; Inventor: Lee, filed Apr. 6, 2017.

(Continued)

*Primary Examiner* — Nyca T Nguyen
(74) *Attorney, Agent, or Firm* — Steven R. Vosen

(57) ABSTRACT

An exercise device that allows users to exercise in a manner that strengthens their core and improve their balance with respect to rotation. The device includes a base for placing on the ground and a board on which the user stands, and includes a pivot between the base and board. The exercise device has a neutral position and also provides a restoring force when the user rotates the board. The restoring force is determined by the shape of the pivot and the supporting elements on the board and/or base.

4 Claims, 10 Drawing Sheets

(56) References Cited

U.S. PATENT DOCUMENTS 5,590,930 A * 1/1997 Glockl ..... A47C 3/0257 297/258.1
5,683,337 A * 11/1997 Zetocha ..... A63B 22/14 482/146
5,728,049 A * 3/1998 Alberts ..... A47C 9/002 297/314
5,810,703 A * 9/1998 Stack ..... A63B 22/18 482/146
6,019,712 A * 2/2000 Duncan ..... A63B 21/0004 446/168
6,413,197 B2 * 7/2002 McKechnie ..... A63B 22/18 482/127
6,602,172 B1 * 8/2003 Aigner ..... A63B 21/0004 482/147
6,695,755 B1 * 2/2004 Huang ..... A63B 22/18 482/146
6,723,030 B1 * 4/2004 Chen ..... A63B 22/18 482/146
7,008,359 B2 * 3/2006 Fan ..... A63B 22/18 482/146
7,094,183 B2 * 8/2006 Hsieh ..... A63B 22/18 482/123
7,591,774 B1 * 9/2009 Tien ..... A63B 22/14 482/146
7,601,107 B2 * 10/2009 Maloy ..... A63B 23/1209 482/123
7,775,952 B1 * 8/2010 Curran ..... A63B 22/18 482/146
7,993,253 B2 * 8/2011 Fernandez ..... A63B 22/18 482/146
8,105,218 B1 * 1/2012 Vayntraub ..... A63B 23/1236 482/141
8,647,239 B1 * 2/2014 Sokolovas ..... A63B 69/10 482/55
8,926,483 B1 * 1/2015 Holloway ..... A63B 26/003 297/271.5
8,979,722 B2 * 3/2015 Klein ..... A63F 13/807 482/129
9,056,222 B2 * 6/2015 Thomason ..... A63B 23/1236
9,327,155 B2 * 5/2016 Doyle ..... A63B 21/00
9,393,458 B1 * 7/2016 LaCaze ..... A63B 21/22
9,788,659 B1 * 10/2017 Jen ..... A47C 9/002
9,987,518 B1 * 6/2018 Stack ..... A63B 22/16
10,010,758 B2 * 7/2018 Osler ..... A47C 9/002
2002/0077231 A1 * 6/2002 Dalebout ..... A63B 22/18 482/146
2003/0125173 A1 * 7/2003 Fan ..... A63B 22/18 482/146
2003/0181300 A1 * 9/2003 Chin ..... A63B 22/14 482/146
2003/0195096 A1 * 10/2003 Hecox ..... A63B 22/18 482/147
2004/0142802 A1 * 7/2004 Greenspan ..... A61H 1/0237 482/146
2004/0256532 A1 * 12/2004 Liao ..... A47C 3/16 248/346.01
2005/0029842 A1 * 2/2005 Martin ..... B62J 1/02 297/199
2006/0105895 A1 5/2006 Lu
2006/0211553 A1 * 9/2006 Cantor ..... A63B 21/0004 482/146
2007/0155603 A1 * 7/2007 Cook ..... A63B 22/18 482/142
2007/0207906 A1 * 9/2007 Blaum ..... A63B 22/18 482/146
2007/0298947 A1 * 12/2007 Eksteen ..... A63B 21/0004 482/141
2008/0039304 A1 2/2008 Mattox
2008/0064578 A1 * 3/2008 Huang ..... A63B 21/0004 482/146
2008/0207412 A1 * 8/2008 Lin ..... A63B 21/015 482/140
2008/0280741 A1 * 11/2008 Baek ..... A63B 22/14 482/146
2009/0163337 A1 * 6/2009 Petrakov ..... A61H 1/005 482/147
2009/0188410 A1 * 7/2009 Billich ..... A47C 3/0255 108/4
2009/0215342 A1 * 8/2009 Sannes ..... A63B 22/18 441/74
2010/0087301 A1 * 4/2010 Juncker ..... A63B 21/0004 482/146
2010/0093506 A1 * 4/2010 Aigner ..... A63B 22/16 482/146
2010/0222187 A1 * 9/2010 Tudico ..... A61H 1/001 482/110
2010/0285941 A1 11/2010 Van Buren
2012/0225741 A1 * 9/2012 Antolick ..... A43B 3/0021 473/452
2012/0264579 A1 * 10/2012 Klein ..... A63B 22/0015 482/146
2013/0053228 A1 * 2/2013 Winegar ..... A63B 22/16 482/146
2013/0116100 A1 * 5/2013 Chen ..... A63B 22/18 482/146
2013/0296147 A1 * 11/2013 Cruz ..... A63B 26/003 482/146
2014/0005018 A1 * 1/2014 Palmer ..... A63B 26/003 482/142
2014/0087927 A1 * 3/2014 Richard ..... A63B 71/0036 482/123
2014/0155236 A1 * 6/2014 Curry ..... A63B 21/023 482/146
2014/0162859 A1 * 6/2014 Cheng ..... A63B 26/003 482/142
2014/0256526 A1 * 9/2014 Henson ..... A63B 22/18 482/146
2014/0274585 A1 * 9/2014 Huang ..... A63B 23/10 482/79
2015/0011369 A1 * 1/2015 Peritz ..... A63B 26/003 482/142
2015/0238793 A1 * 8/2015 Kramer ..... A63C 17/0093 482/142
2015/0238798 A1 * 8/2015 Liu ..... A63B 22/16 482/127
2016/0059070 A1 * 3/2016 Tung ..... A63B 21/0552 482/112
2016/0206918 A1 * 7/2016 Palmer ..... A63B 69/0093
2017/0231549 A1 * 8/2017 Kogler ..... A63B 22/0015 600/595
2017/0304675 A1 * 10/2017 Panes ..... A63B 23/0211
2018/0117384 A1 * 5/2018 Endelman ..... A63B 21/4034

OTHER PUBLICATIONS

Office Action for co-pending U.S. Appl. No. 15/480,368 dated Jun. 6, 2018.
Office Action for co-pending U.S. Appl. No. 15/480,368 dated May 2, 2019.

* cited by examiner

FIG. 6A
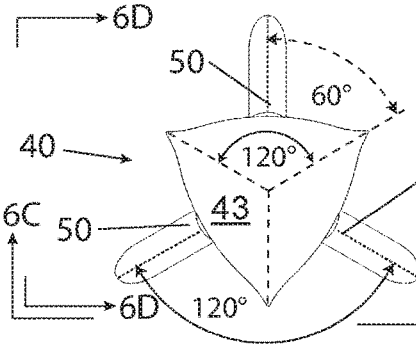
FIG. 6B
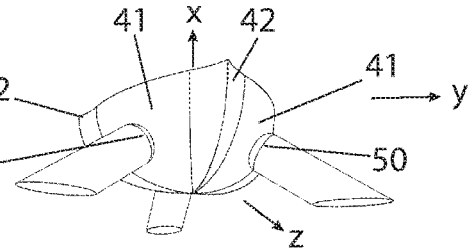
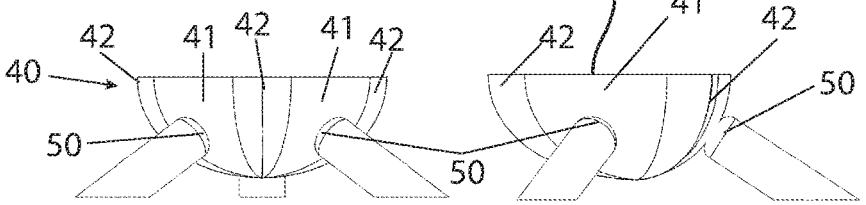
FIG. 6C
FIG. 6D
FIG. 7A
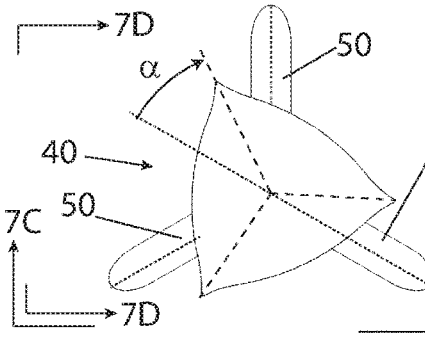
FIG. 7B
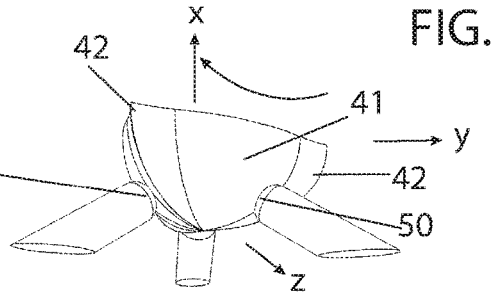
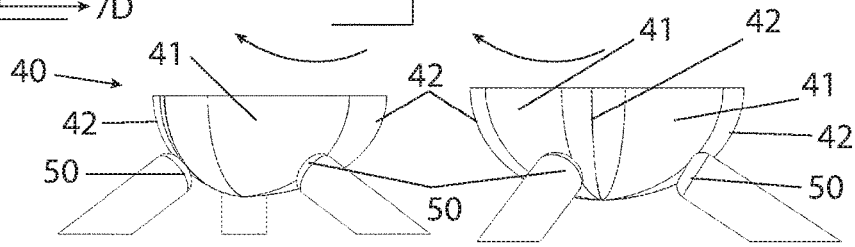
FIG. 7C
FIG. 7D FIG. 9A
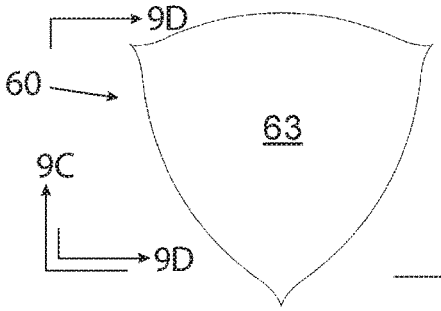
FIG. 9B
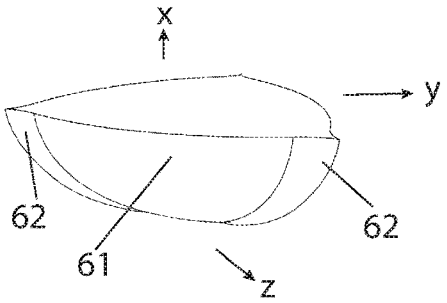
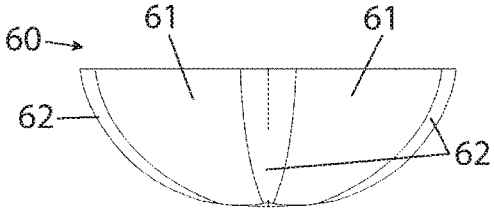
FIG. 9C
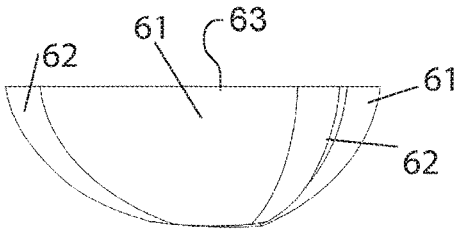
FIG. 9D
FIG. 10A
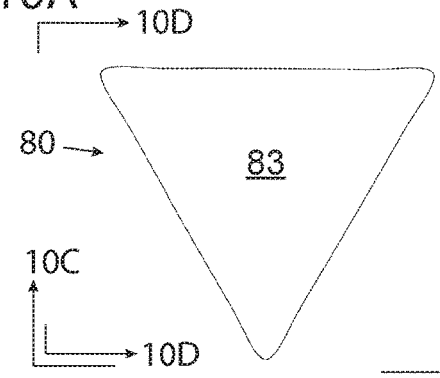
FIG. 10B
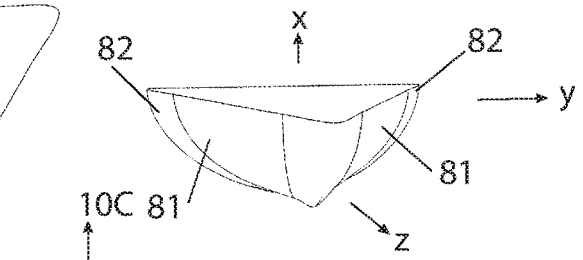
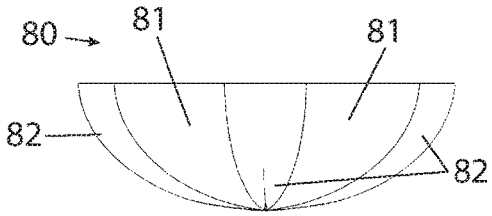
FIG. 10C
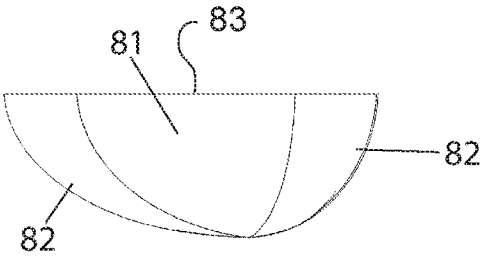
FIG. 10D

BALANCE BOARD

CROSS-REFERENCE TO RELATED APPLICATIONS

This application claims the benefit of U.S. Provisional Application No. 62/313,857, filed Mar. 28, 2016, whose contents are hereby incorporated by reference in its entirety.

BACKGROUND OF THE INVENTION

Field of the Invention

This invention relates generally to the field of sports and exercise equipment, and, in particular to a balance board for improving and developing the balancing ability of an individual.

Discussion of the Background

Many popular sports activities require a well-developed balance to become proficient. For example, sports such as cycling, skiing, snowboarding, skateboarding, kayaking, paddling, boxing, martial arts, and surfing all involve the use of equipment that requires the user to be able to accurately control their position on the equipment. Continuous shifting and adjustment of the user's weight and center of gravity with respect to the equipment at appropriate times is vital to proper use of the equipment and full enjoyment of the sport.

Exercise equipment, usually referred to as a "balance board," allows users to exercise in a manner that requires that they develop their balancing skills. Balance boards typically include a platform that is supported on the ground by a mechanism that permits the platform to rock and swivel or rotate.

While prior art balance boards allow a user to develop their balance, the boards have some features that make them difficult to use. Thus, for example, such boards typically permit a wide range or unlimited movement, including rotation, making it difficult for beginners to use the devices. In addition, the wide range and/or unlimited movement of prior art balance boards do not simulate certain exercises, and thus do not provide useful training. Thus, for example, boxing or kayaking moves cannot be performed on prior art balance boards, since one punch or swing would result in the user spinning around until they stopped themselves from rotating or fell off.

Thus there is a need in the art for an apparatus that permits for users to develop balancing skills, while providing movement over a limited range and/or rotation. Such an apparatus should be simple and inexpensive to construct and should be usable for a wide range of different exercises.

BRIEF SUMMARY OF THE INVENTION

The present invention overcomes the disadvantages of prior art balance boards by providing a balance board with a pivot, where a restoring force is provided when the user rotates their body of the board. Thus, for example, the inventive balance board may include a base for placing on the ground, a board for supporting a user, and pivot located between and contacting or affixed to the base and board. The shape of the pivot and contacts provides a neutral position for the board relative to the base, and restoring forces when the board is rotated from the neutral position.

It is one aspect to provide an embodiment of an exercise apparatus for a user that includes a base for placing on the ground, where the base has a base axis that is perpendicular to the ground; a board including a platform to accept a body part of the user, where the board has a board axis that is perpendicular to the platform; and a pivot disposed between, and in contact with, the base and the board. The board has a neutral position relative to the base wherein the pivot does not impart a rotational force on board about the board axis. When the board is rotated about the board axis away from the neutral position, the pivot imparts a torque on the board about the board axis.

It is one aspect to provide an embodiment of an exercise apparatus for a user that includes a base for placing on the ground, where the base has a base axis that is perpendicular to the ground; a board including a platform to accept a body part of the user, where the board has a board axis that is perpendicular to the platform; and a pivot disposed between, and in contact with, the base and the board, and having slidable contact with at least one of the base and the board. The pivot has three-fold symmetry in an axis between the base and the board and where points of slidable contact between the pivot and the at least one of the base and the board has three-fold symmetry.

It is yet another aspect to provide an embodiment where the pivot is affixed to one of the base or the board and where the other of the base or the board includes a support to slidably contact the pivot.

It is one aspect to provide an embodiment where the support includes three supports equally spaced about the base axis, where at least a portion of the surface of the pivot has three-fold symmetry about the board axis.

It is one aspect to provide an embodiment with replaceable pivots.

It is yet another aspect to provide an embodiment where the pivot is not affixed to either the board or base of the exercise device.

These features together with the various ancillary provisions and features which will become apparent to those skilled in the art from the following detailed description, are attained by the core rotation and balance board of the present invention, preferred embodiments thereof being shown with reference to the accompanying drawings, by way of example only, wherein:

BRIEF DESCRIPTION OF THE SEVERAL VIEWS OF THE DRAWING

FIG. 6A is a top view, FIG. 6B is a lower right perspective view, FIG. 6C is a bottom side elevation view, and FIG. 6D is a right side elevation view of a first embodiment pivot in a neutral position as resting on fixed contact points;

FIG. 7A is a top view, FIG. 7B is a lower right perspective view, FIG. 7C is a bottom side elevation view, and FIG. 7D is a right side elevation view of the first embodiment pivot near maximum clockwise rotation relative to the fixed contact points;

FIG. 9A is a top view, FIG. 9B is a lower right perspective view, FIG. 9C is a bottom side elevation view, and FIG. 9D is a right side elevation view of a second embodiment pivot;

FIG. 10A is a top view, FIG. 10B is a lower right perspective view, FIG. 10C is a bottom side elevation view, and FIG. 10D is a right side elevation view of a third embodiment pivot;

Reference symbols are used in the Figures to indicate certain components, aspects or features shown therein, with reference symbols common to more than one Figure indicating like components, aspects or features shown therein.

DETAILED DESCRIPTION OF THE INVENTION

Embodiments are presented herein of an exercise device referred to herein, without limitation, as a core rotation and balance board, or as a "balance board." In general, a balance board includes a platform on which a user may stand that is supported on the ground by a base. The user may rotate the platform about several axes independently, such as along axis both parallel and perpendicular to the ground. In this way, a user may perform many types of exercises while acting to maintain their balance.

Figure 1:
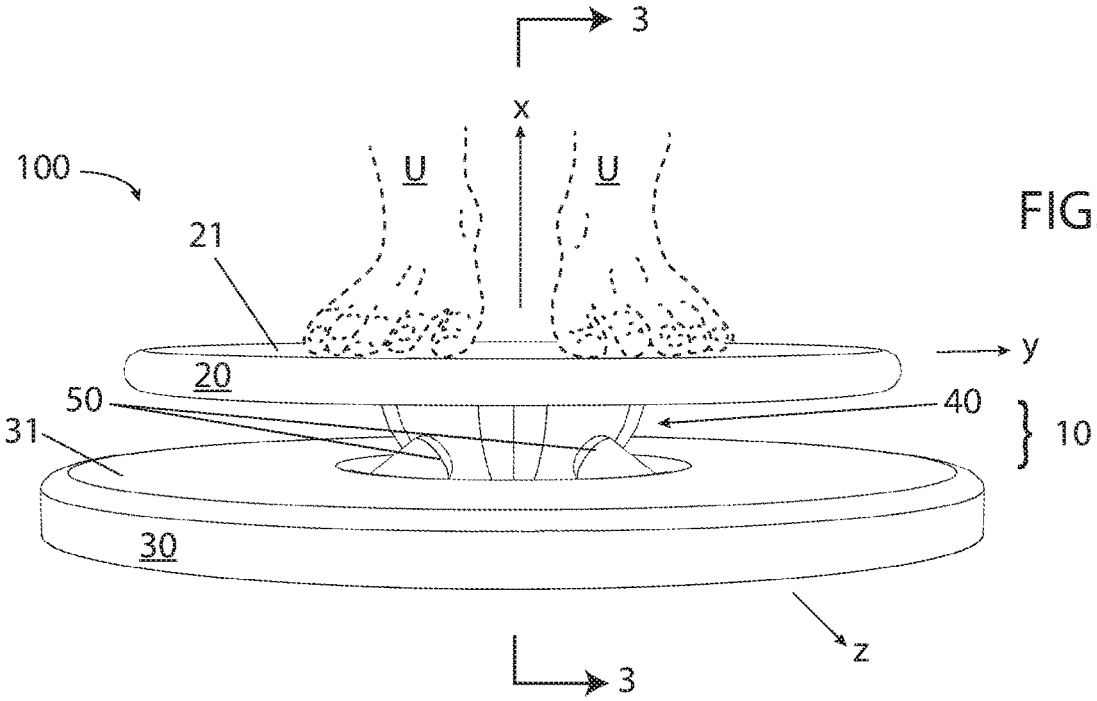
FIG. 1 illustrates a user balancing on a first embodiment balance board.
Figure 2:
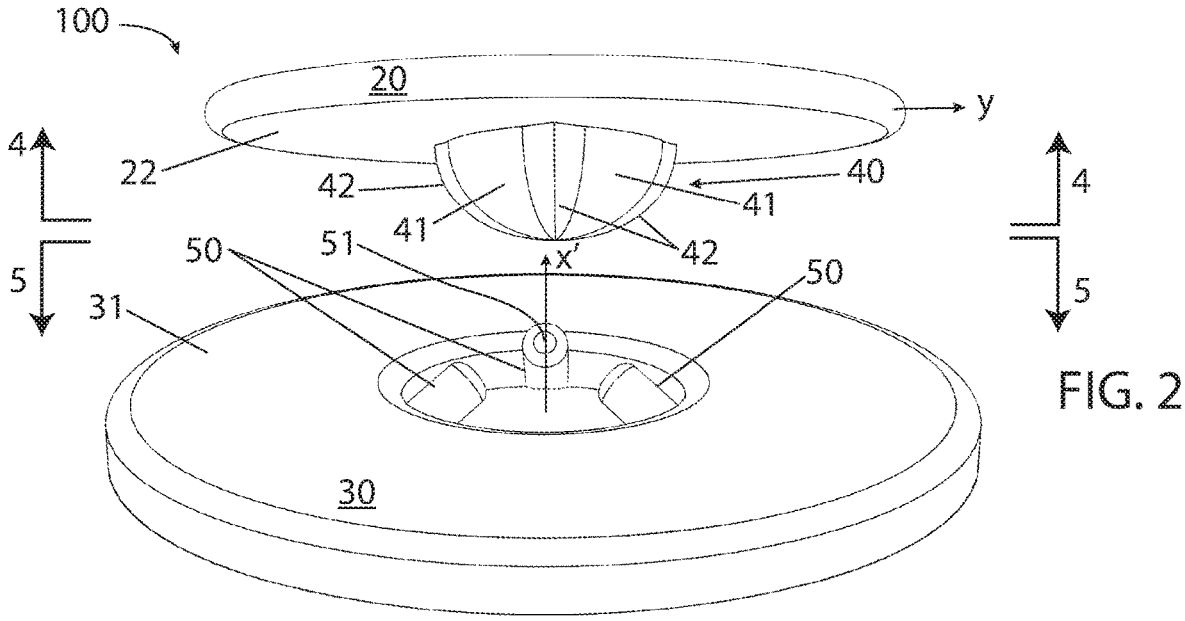
FIG. 2 is an exploded perspective view of the balance board of FIG. 1.
Figure 3:
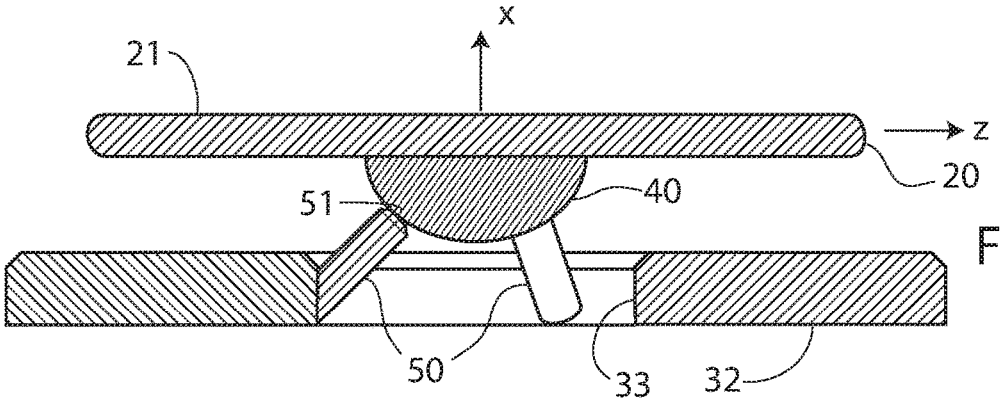
FIG. 3 is a sectional view 3-3 of FIG. 1.
Figure 4:
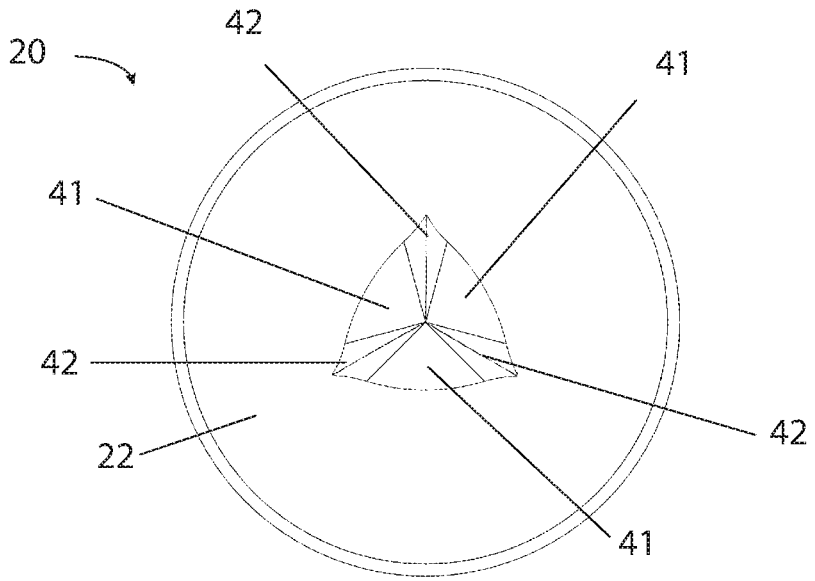
FIG. 4 is a view 4-4 of FIG. 2 showing a bottom view of the board of FIG. 1.
Figure 5:
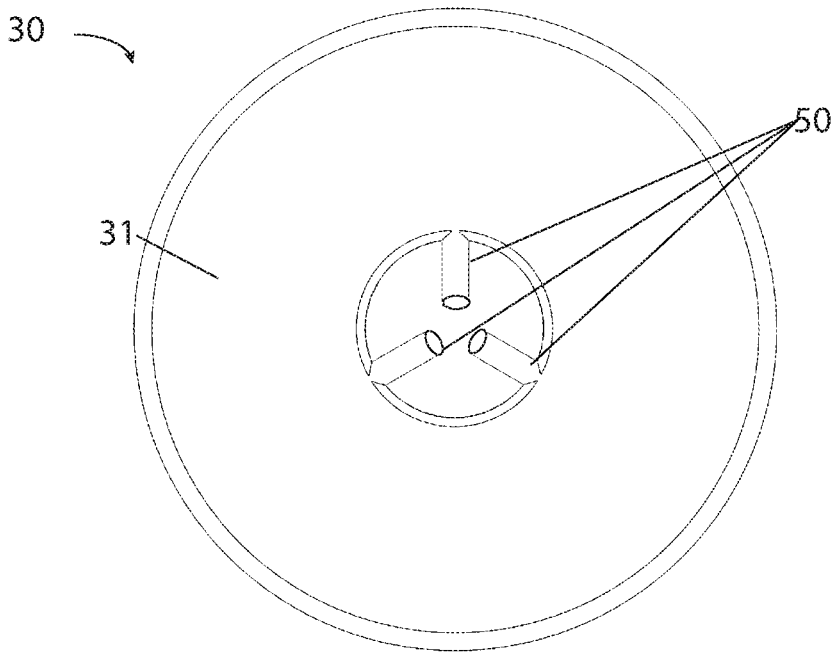
FIG. 5 is a view 5-5 of FIG. 2 showing a top view of the base of the board of FIG. 1.

A first embodiment balance board 100, is illustrated in the perspective view of FIG. 1, and in an exploded perspective view of FIG. 2, a sectional view 3-3 of FIG. 1 in FIG. 3, a bottom view of the board as indicated in view 4-4 of FIG. 2 in FIG. 4, and in a top view of the base as indicated as view 5-5 of FIG. 2 in FIG. 5.

Balance board 100, includes a base 30, a board 20, and a mechanism 10 that allows for rotation of the board relative to the base. Thus, for example, base 30 includes a bottom 32 for placing on the ground and an opposing top surface 31 and includes an opening 33 and three supports 50 which are attached to or are integrally formed as part of the base. Board 20 includes a platform 21 sized to accept the feet of a user, U, and an opposing bottom surface 22 that generally faces top surface 31 and to which a protruding pivot 40 is attached or integrally formed into the board. Mechanism 10 includes pivot 40 and three supports 50. With base 30 placed on the ground and with board 20 supporting user U, pivot 40 contacts each of three supports 50 at a respective support end 51, while the base remains fixed on the ground. Opening 33 is sized to accept part of pivot 40, as shown in FIGS. 1-3.

In general, platform 21 is large enough for a user to comfortably stand and thus, for example and without limitation, board 20 may be circular with a diameter of from approximately 16 inches to 20 inches, or may be noncircular but having a size to accept the user's feet, and be formed of a material that is rigid under the weight of the user. Board 20 may be made of wood, plastic or metal with sufficient thickness to maintain its shape when supporting a user. Base 30 may be made of the same or different materials than board 20. Pivot 40 may be made of, or have an outer layer of plastic, such as high-density polyethylene, wood, or metal.

In use, base 30 does not move on the ground, while board 20 moves relative to base 30 according to the weight and forces applied by user U to platform 21 according to the action of mechanism 10. It is convenient to define axis relative to base 30 and board 20 to aid in the discussion of such movement. FIGS. 1 and 3 show a set of reference orthogonal axes fixed relative to board 20 as an x axis that extends perpendicularly upwards from the board (see FIGS. 1 and 3) and perpendicular and in the plane of the board an y axis (see FIG. 1) and a z axis (see FIG. 3). Thus, the x axis is generally in line with the posture of a user U that is standing on platform 21, and the x, y, and z axis move with the user. FIG. 2 also shows a reference axis x' fixed relative to base 30 as extending upwards and perpendicular to the base.

Mechanism 10, and especially the contact of pivot 40 and supports 50, may be configured to permit platform 21 to rotate about one or more of the x, y and z axis with each of support ends 51 always in contact with some portion of the pivot surface. That is, the pivot slidably contacts the supports as board 20 rotates relative to base 30. Depending on the shape of a surface of pivot 40 and the weight of user U, such movement may result in forces along the x, y, and/or z axis against which the user will work to balance or work on certain muscle groups. In one embodiment, pivot 40 has rotational symmetry about the x axis and mates with support ends 51 which also have the same rotation symmetry about the x' axis. The rotational symmetry of pivot 40 and supports 50, for example, are seen in FIGS. 4 and 5. Thus, for example and as illustrated in many of the embodiments discussed herein, pivot 40 and support ends 51 are described having three-fold symmetry—that is, pivot 40 is generally a three-sided element with generally triangular shaped surfaces attached to bottom surface 22 that repeat their shape every 120° about the x axis, and the three support ends 51 are equally spaced every 120° around the x' axis. The base of pivot 40, that is where it meets bottom surface 22, may be from 1 inch to 6 inches, and the height may be from 1 inch to 6 inches. This arrangement allows board 20 to rotate about the x axis, and the center of supports 50, by less than 120°, while maintaining contact between support ends 51 and pivot 40. Rotational forces about the x axis and longitudinal forces along the x axis depend on the shape of pivot 40.

More specifically regarding the embodiment of FIGS. 1-3, mechanism 10 operates as follows. As shown in FIG. 2, pivot 40 includes three surfaces 41 and three corners 42 having three-fold symmetry about axis x, which is perpendicular to bottom surface 22, as discussed subsequently. Each of the three supports 50 is uniformly spaced about an axis perpendicular to bottom 32, protrudes the same height above bottom 32 and is capped with a respective support end 51 that angles in towards the centerline of the axis, and thus has a three-fold symmetry about the x' axis.

In alternative embodiments, only portions of pivot 40 have three-fold symmetry, providing rotation about the x axis of less than 120°. In yet other alternative embodiments, there may be two-fold symmetry, four-fold symmetry, or greater, each providing more limited rotation about the x axis. In other alternative embodiments, a hemispherical pivot 40 has rotational symmetry about the x axis.

Under the force of the weight of user U, pivot 40 thus contacts support ends 51 and, as discussed subsequently, depending on the shape of surfaces 41 and corners 42, mechanism 10 permits board 20 both: 1) rotate about the x axis while imparting a torque about the x axis to restore the board to a neutral position where each corner 42 is equally spaced between a support end 51; and 2) rotate about the y axis and z axis.

Reference is made herein to a "neutral position" of balance board 100. In the neutral position, the x axis is coaxial with the x' axis—that is, the board 20 and base 30 are parallel, and thus the y axis and z axis are parallel to the ground. In the neutral position, pivot 40 is supported by support ends 51 with corners 42 positioned equidistant from the support ends. Thus in the case of mechanism 10, the angular spacing between adjacent support ends 51 and corners 42 is 60°.

FIGS. 6A, 6B, 6C, and 6D are views of pivot 40 and supports 50 with board 100 in the neutral position, where FIG. 6A is a top view, FIG. 6B is a lower right perspective view, FIG. 6C is a bottom side elevation view 6C-6C of FIG. 6A, and FIG. 6D is a right side elevation view 6D-6D of FIG. 6A.

As is shown in FIG. 6A, the interior angle between adjacent corners 42 and the interior angle between adjacent supports 50 is 120°. In the neutral position, corners 42 are midway between supports 50, and thus there is an angle of 60° between the corners and supports. In addition to the three surfaces 41 and three corners 42 of pivot 40, FIGS. 6A and 6D show the base 43 of the pivot. Thus, in one embodiment, the pivot is formed from a rigid plastic or metal as having base 43, surfaces 41 and corners 42, and base 43 is affixed to bottom surface 22.

FIGS. 7A, 7B, 7C, and 7D are views of pivot 40 and supports 50 resulting from a clockwise rotation of board 20 by an angle ⍰ about axis x from a neutral position, where FIG. 7A is a top view, FIG. 7B is a lower right perspective view, FIG. 7C is a bottom side elevation view 7C-7C of FIG. 7A, and FIG. 7D is a right side elevation view 7D-7D of FIG. 7A. As is shown in FIG. 7A, the pivot 40 and supports 50 are rotated clockwise by an angle ⍰ relative to the orientation in FIG. 6A. As a result of the curvature of surfaces 41, the effect of the clockwise rotation of board 20 relative to base 30 is to impart a counterclockwise force on the board. In addition, depending on the shape of surfaces 41, the rotation also imparts other forces on board 20. Thus, for example, with the shape of pivot 40, rotation from the neutral position of FIG. 6A will impart a force to push board upwards (away from) base 30. Corners 42 act as a stop to prevent rotation by more than 60°. A counterclockwise rotation of board 20 from the neutral position of FIG. 6A also results in a restoring torque about the x axis and an upwards force on board 20.

Figure 8:
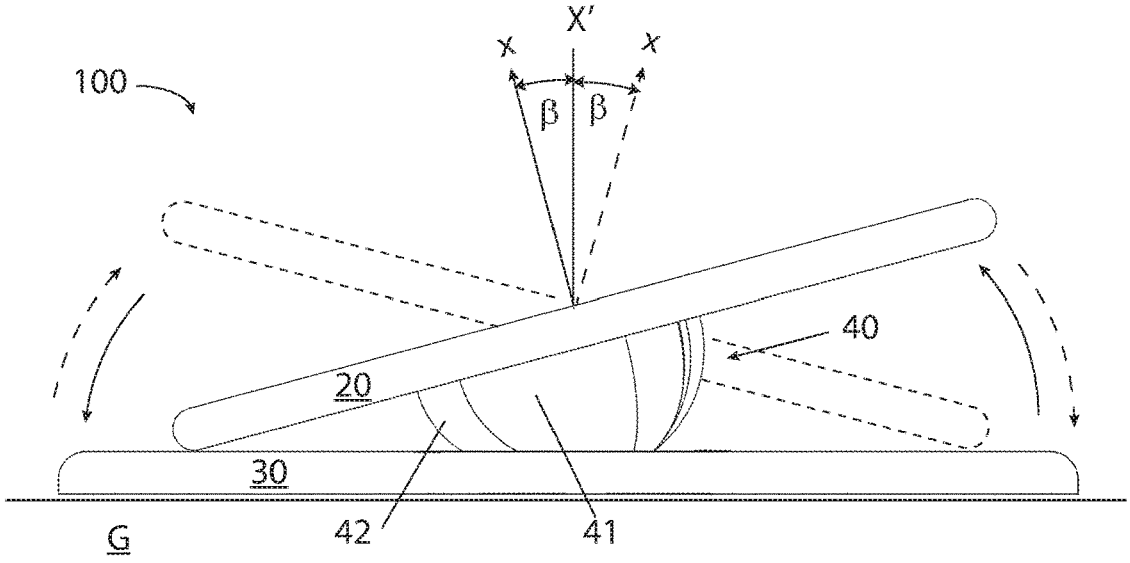
FIG. 8 is an elevation view showing the range of tipping of the balance board of FIG. 1.

FIG. 8 is an elevational view showing the range of tipping of core rotation and balance board 100 of FIG. 1. In this figure, base 30 is shown on ground G, and board 20 is tilted about the y and/or z axis result in the edges of the board touching the base, thus limiting the rotation about the y axis and z axis to the indicated range of ±β degrees, depending on the board and base dimensions and the height of pivot 40.

Alternative Embodiments

Alternative embodiments of the inventive balance board, which operate essentially as described above, may include one or more of different pivot shapes, including different surface shapes and overall size. More specifically, since the forces on the user using the balance board depend on the shape of the pivot, the pivot shape determines the ease of use of the balance board. It is envisioned that a variety of balance boards with different pivots will be made available to the user, with increasing difficulty as the user progresses through their training. Alternatively, the balance board will be configured to allow the user to replace the pivots by including a quick release mechanism, for example, so that the user may exchange pivots to achieve different levels of work out. The following discussion is meant to illustrate some of the many possible alternative embodiments, which may be combined to form alternative core rotation and balance boards.

A second embodiment pivot 60 is shown in FIGS. 9A, 9B, 9C, and 9D, where FIG. 9A is a top view, FIG. 9B is a lower right perspective view, FIG. 9C is a bottom side elevation view 9C-9C of FIG. 9A, and FIG. 9D is a right side elevation view 9D-9D of FIG. 9A. Pivot 60 is generally similar to the pivot 40, except where explicitly stated.

Pivot 60 may work in conjunction with supports 50 or any other suitably configured support described herein. Pivot 60 includes three surfaces 61, which are generally similar to surfaces 41, three corners 62, which are generally similar to corners 42, and a base 63. Surfaces 61, corners 62, and base 63 each have three-fold symmetry along the x axis (that is, when looking down on the pivot, as in FIG. 9A, and generally interacts as part of mechanism 10 as does pivot 40. Since surfaces 61 are rounder than surfaces 41, there is less restoring force when pivot 60 is rotated from a neutral position relative to the supports, and there is less of an upwards force as well.

A third embodiment pivot 80 is shown in FIGS. 10A, 10B, 10C, and 10D without other portions of base 30, supports 50, or board 20 to show the contact of the components of the pivot, where a top view is shown in FIG. 10A, a lower right perspective view is shown in FIG. 10B, a bottom side elevation view 10C-10C of FIG. 10A is shown in FIG. 10C, and a right side elevation view 10D-10D of FIG. 10A is shown in FIG. 10D.

Pivot 80 may work in conjunction with supports 50 or any other suitably configured support described herein. Pivot 80 includes three surfaces 81, which are generally similar to surfaces 41 or 61, and three corners 82 generally similar to corners 42 or 62, that have three-fold symmetry from the top view of FIG. 10A, and generally interacts as part of mechanism 10 as does pivot 40 or 60. Since surfaces 81 are flatter than surfaces 41, there is more restoring force when pivot 80 is rotated from a neutral position relative to the supports, and there is more of an upwards force as well.

Figure 11A:
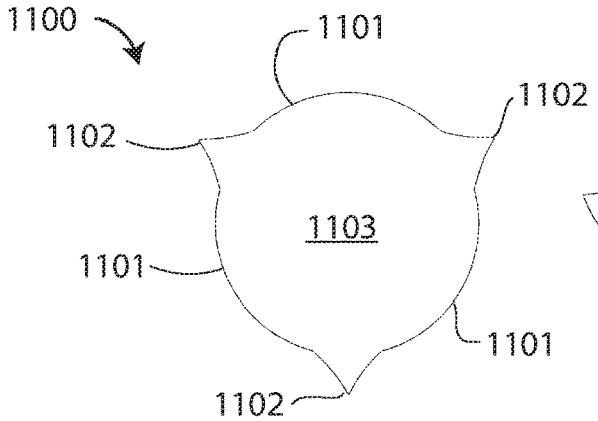
FIG. 11A is a top view.
Figure 11B:
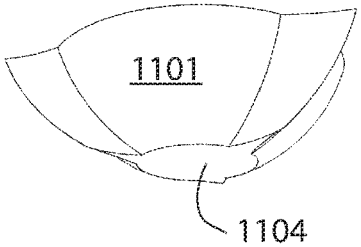
FIG. 11B is a perspective view.
Figure 11C:
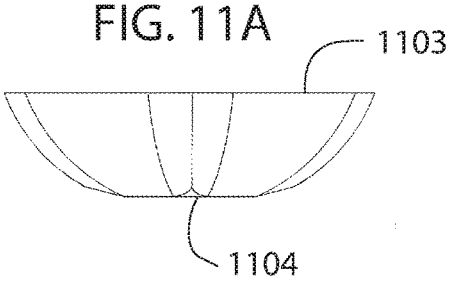
FIG. 11C is an elevation view of a fourth embodiment pivot.

FIGS. 11A, 11B, and 11C are a top view, perspective view, and elevational view, respectively, of a fourth embodiment pivot 1100 which is generally similar to the other pivot embodiments, except as explicitly stated.

Pivot 1100 has three surfaces 1101, three corners 1102, a base 1103, and a distal surface 1104. Surface 1101 forms part of a sphere and thus provides little restoring force when moved from a neutral position.

Figure 12:
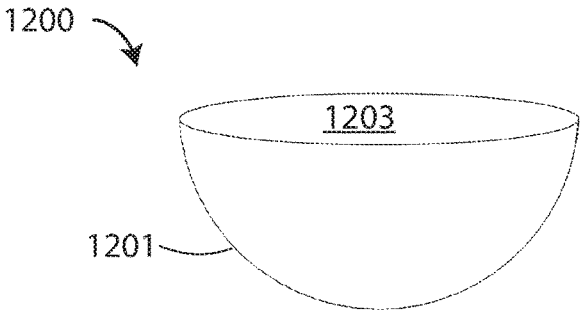
FIG. 12 is a top perspective view of a fifth embodiment pivot.

FIG. 12 is a top perspective view of a fifth embodiment pivot 1200 which is generally similar to the other pivot embodiments, except as explicitly stated. Pivot 1200 has a base 1203 and a hemi-spherical surface 1201. Unlike the other pivots, pivot 1200 does not have corners to limit rotation of the board, such as board 20. The use of pivot 1200 will support board 20 without imparting a rotational force.

Figure 13A:
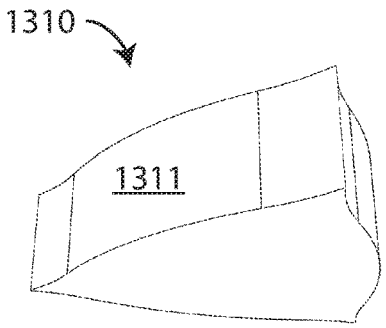
FIG. 13A is a perspective view of a sixth embodiment pivot.
Figure 13B:
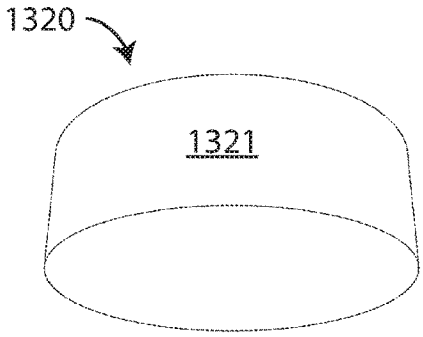
FIG. 13B is a perspective view of a seventh embodiment pivot.

FIG. 13A is a perspective view of a sixth embodiment pivot 1310 having surfaces 1311, and FIG. 13B is a perspective view of a seventh embodiment pivot 1320 having surfaces 1321. Surfaces 1311 and 1321 are both generally parallel to axis x, and thus these pivots generally reduce or eliminate tilting of board 20 about the y axis and z axis.

Figure 14:
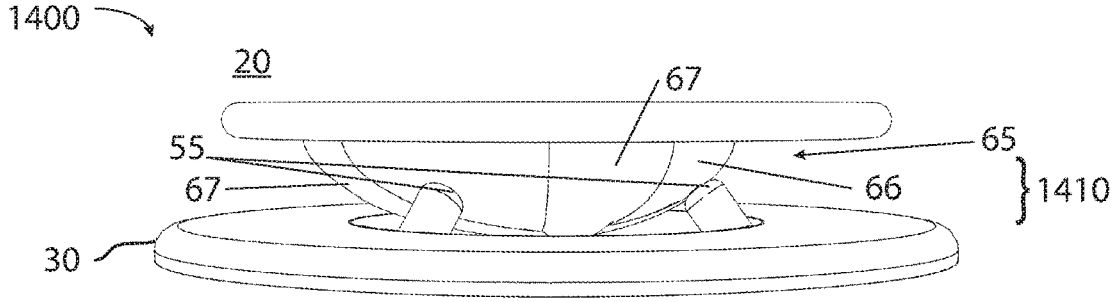
FIG. 14 is a perspective view and FIG. 15 is an exploded perspective view, respectively, of a second embodiment balance board.
Figure 15:
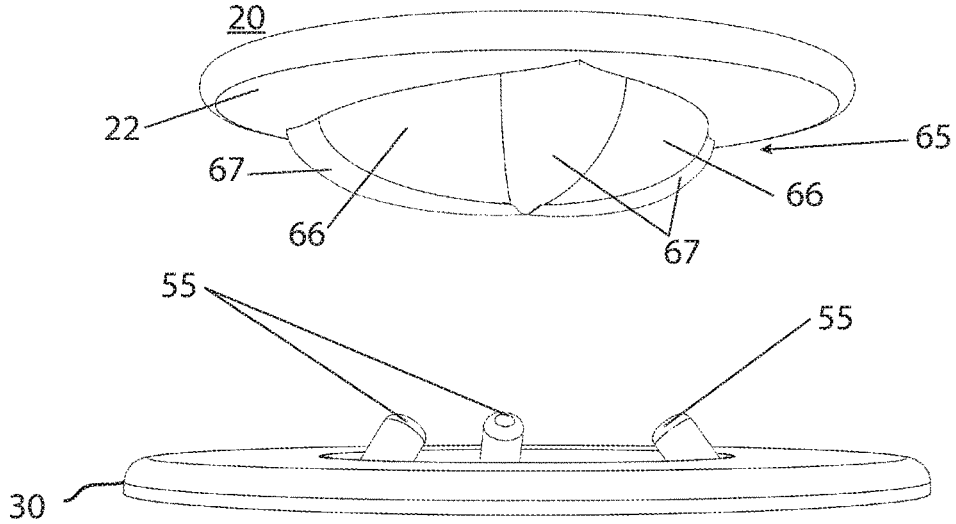

FIGS. 14 and 15 illustrate a perspective view and an exploded perspective view, respectively, of a second embodiment balance board 1400 which is generally similar to balance board 100, and which includes a mechanism 1410 which is generally similar to mechanism 10, except as explicitly stated.

Mechanism 1410 includes a pivot 65 attached to board 20, where the pivot is wider, in the x-y plane, than pivots 40, 60, or 80, for example, resulting in the distance between the central x axis and surfaces 66 being greater than is the case for the other pivots. The increased distance translates into an increased radius, which in turn contributes to creating a larger balancing point. As a result, the wider pivot is easier for the user to stabilize along the x, y and z-axis. Base 30 is adapted to accommodate the larger pivot with increase length of supports 55. There is also an increased distance between the supports, or increased radius of placement for supports, while still maintaining the three-fold symmetry.

Figure 16:
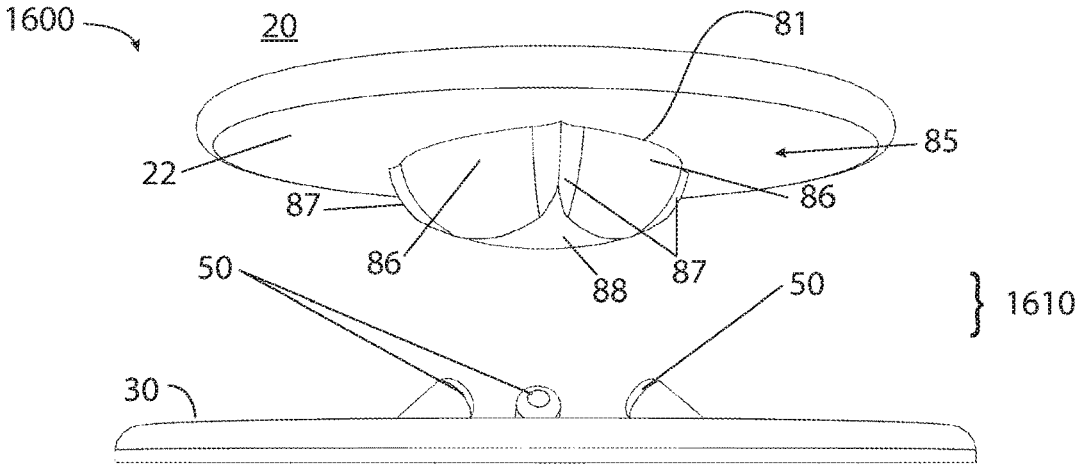
FIG. 16 is an exploded perspective view of a third embodiment balance board.

FIG. 16 is an exploded perspective view of a third embodiment balance board 1600 which is generally similar to balance boards 100 or 1400, and which includes a mechanism 1610 which is generally similar to mechanisms 10 or 1410, except as explicitly stated.

Mechanism 1610 includes a pivot 85 having a base 81 that is attached to the bottom surface 22 of board 20 which includes surfaces 86, generally similar to surface 41, 61, or 81, for contacting supports 50, corners 87, generally similar to corners 42, 62, or 82, to act as a rotational stop for board 20, and a generally spherical-shaped surface 88 at the lowest point of the pivot.

In addition to operating in a manner similar to balance boards 100 or 1400, the board 20, including pivot 85, may be removed from base 30 and placed directly on the ground and due to the curved shape of surface 88 may be used in the absence of base 30 for balance training.

Figure 17:
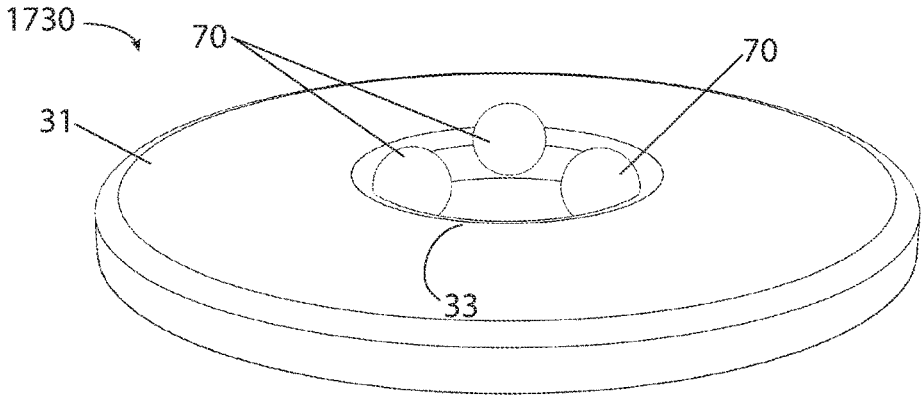
FIG. 17 is a top perspective view of a second embodiment base.

Balance board may also include alternative bases, which may be used with any of the above boards or pivots. FIG. 17 is a top perspective view of a second embodiment base 1730. Base 1730 is generally similar to base 30, except as explicitly stated.

Base 1730 includes, as supports, three spherical shaped members 70 that are attached to the base and which protrude into opening 33. The spherical shaped members 70 may be, for example and without limitation, ball bearings fixed to base 30. Members 70, as part of mechanism 10 will, with an appropriately sized opening 33, support and interact with any of the pivots described herein, including but not limited to pivot 40, 60, or 80.

Figure 18:
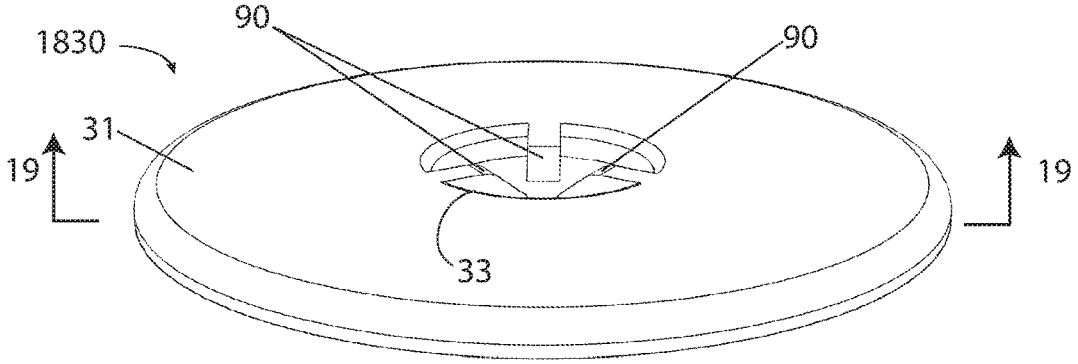
FIG. 18 is a top perspective view and FIG. 19 is an elevational sectional view 19-19 of FIG. 18, respectively of a third embodiment base.
Figure 19:
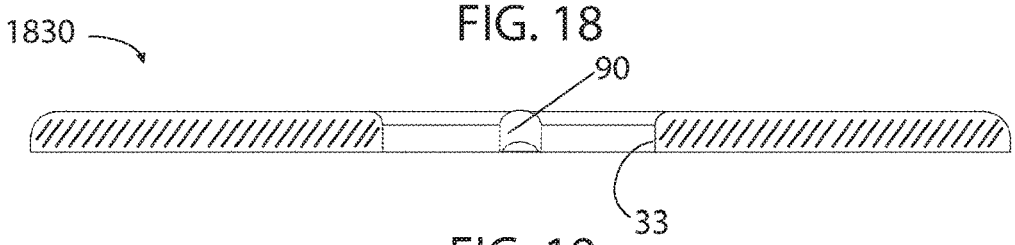

FIG. 18 is a top perspective view and FIG. 19 is an elevational sectional view 19-19 of FIG. 18, showing a third embodiment base 1830. Base 1830 is generally similar to base 30, or 1730, except as explicitly stated.

Base 1830 includes, as supports, three elements 90 that are attached to, or formed integrally with, the base and which protrude into opening 33. Members 90, as part of mechanism 10 will, with an appropriately sized opening 33, support and interact with any of the pivots described herein, including but not limited to pivot 40, 60, or 80.

Figure 20A:
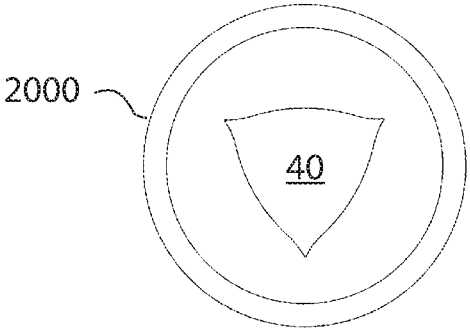
FIG. 20A is bottom view.
Figure 20B:
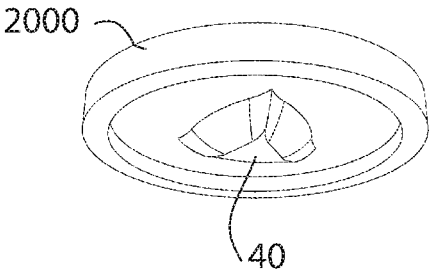
FIG. 20B is a bottom perspective view.
Figure 20C:
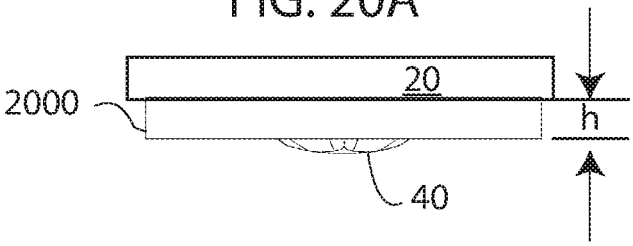
FIG. 20C is an elevation view, respectively, of ring that may be added near the pivot.
Figure 21:
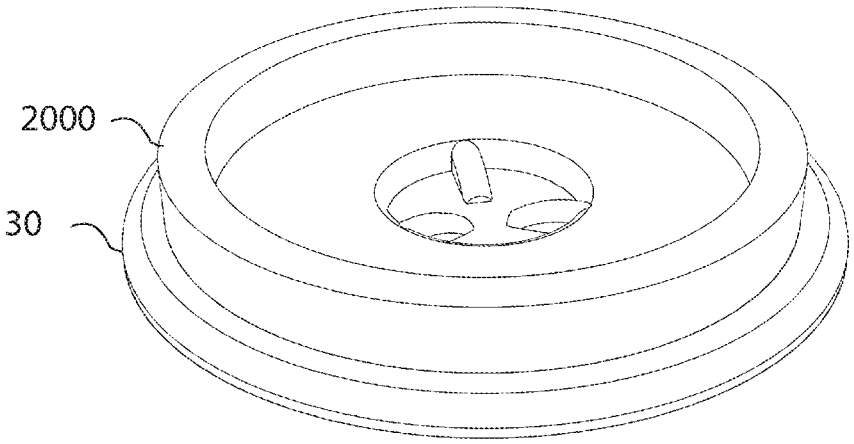
FIG. 21 is a top perspective view of ring added on the base.

Elements may also be added to any of the balance boards presented herein to limit tilting of the board. FIG. 20A is bottom view, FIG. 20B is a bottom perspective view, and FIG. 20C is an elevation view of ring that may be added near the pivot to limit tilting about the y axis or z axis. Specifically, a ring 2000 having a height h is centered about pivot 40 on the bottom side of board 20. If board 20 tilts to far about the y axis or z axis, then ring 2000 will contact base 30 and limit the motion of the board. FIG. 21 is a top perspective view of ring 2000 added on the top of base 30. As with the embodiment of FIG. 20A, the ring will prevent excessive tilting about the y axis and z axis.

Figure 22:
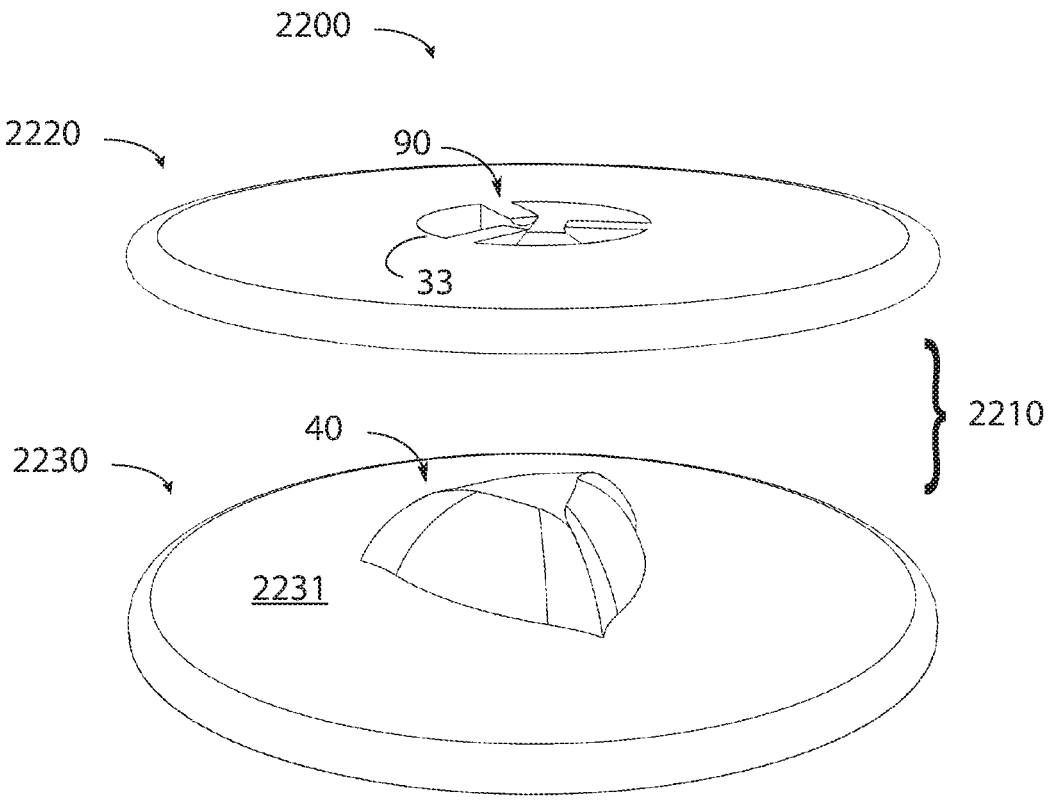
FIG. 22 is a top perspective exploded view of another alternative balance board.

FIG. 22 is a top perspective exploded view of another alternative balance board 2200, which is generally similar to balance board 100, except as explicitly stated.

Balance board 2200 differs from balance board 100 in that a mechanism 2210 is provided that as the opposite orientation to the ground from mechanism 10. Thus, balance board 2200 has a board 2220 with an opening and support elements 90 that protrude inwards, and a base 2230 having pivot 40 attached to a top surface 2231. It is apparent that when board 2220 is placed on base 2230, that board 2220 may move in a manner very similar to board 100.

Figure 23:
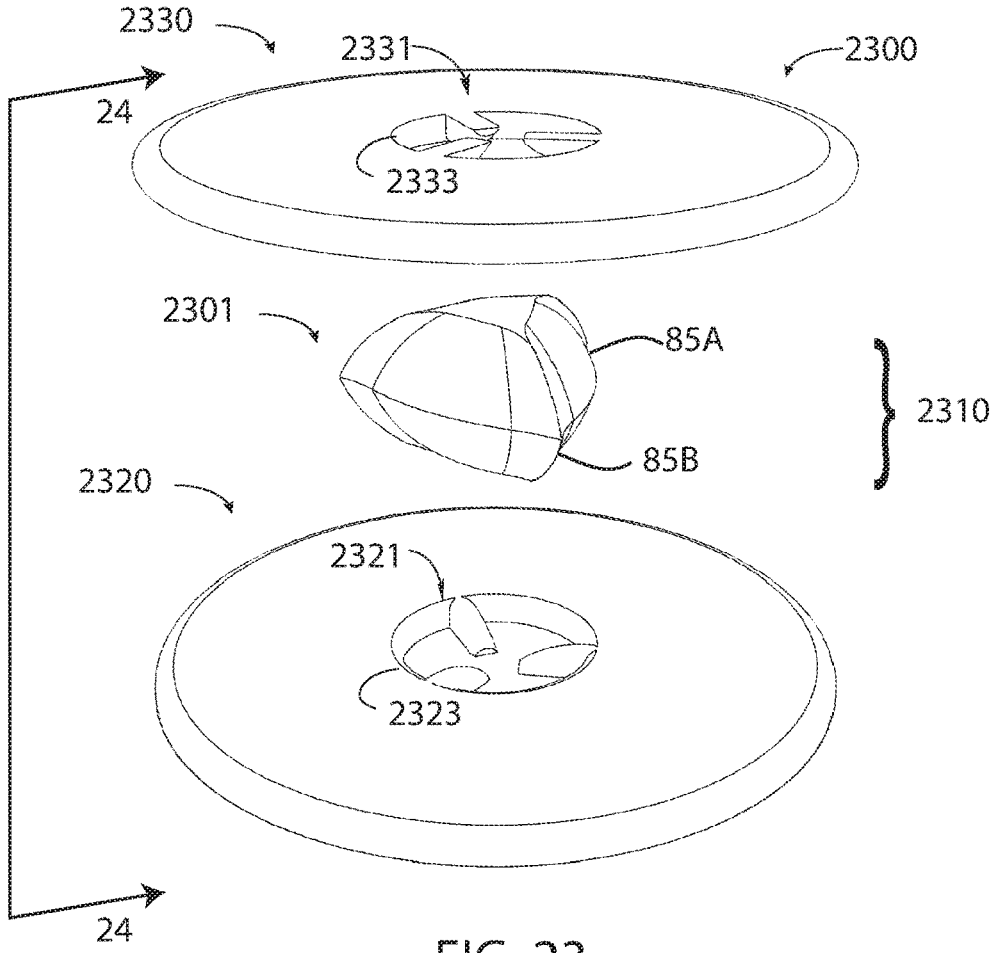
FIG. 23 is an exploded side perspective view of an alternative embodiment balance board.
Figure 24:
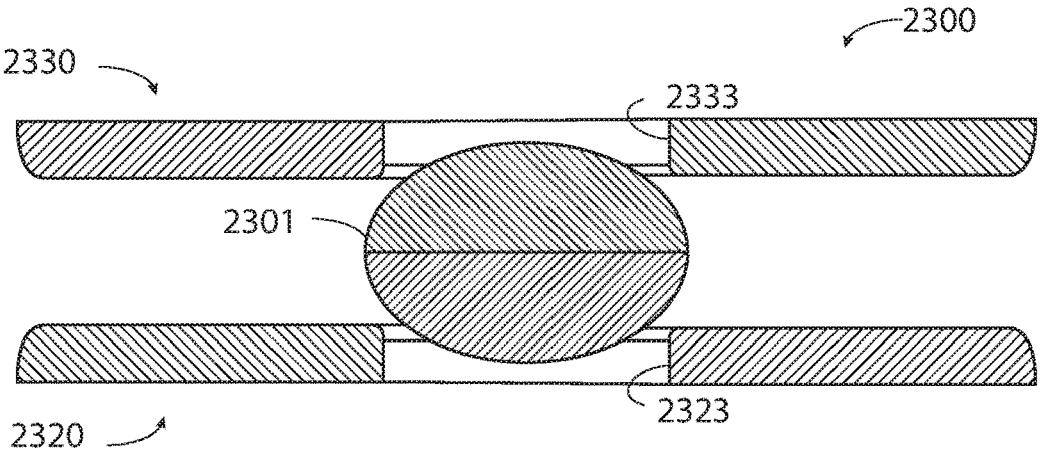
FIG. 24 is a sectional side view, 24-24, of the embodiment of FIG. 23 in an assembled configuration.

FIG. 23 is an exploded side perspective view of an alternative embodiment balance board 2300, and FIG. 24 is a sectional side view, 24-24, in an assembled configuration. Balance board 2300 is generally similar to balance board 100, except as explicitly stated.

Balance board 2300 differs from balance board 100 in that the pivot is not attached to either the base or the board, but instead contacts and rotates separately from the supports on the base and the board. More specifically, balance board 2300 includes a board 2330 having an opening 2333 and three supports 2331, a base 2320 having an opening 2323 and three supports 2321, and a pivot 2301. Mechanism 2310 includes supports 2331 and 2321 and pivot 2301. Pivot 2301 includes a board-engaging, upper pivot portion 85A and a base-engaging, lower pivot portion 85B. Pivot portions 85A and 85B are generally the same as pivot 85 and are formed by joining the respective bases of the pivot portions.

Supports 2321 and 2331 may, be the same or may be different from each other, and may for example and without limitation, be the same as any of the supports described herein. Pivot 2301 is, preferably a shape with three-fold symmetry or may be spherical, as described with respect to the other pivots disclosed herein. In one embodiment, pivot 2301 is formed from two identical pivots, including, but not limited to, pivot 85, which are attached at their bases. Thus, for example and without limitation, pivot 2301 may be formed from a pair of any of the other pivots described herein with, joined at their respective bases.

The action of balance board 2300 is similar to that of balance board 100. Thus, balance board 2300 has a neutral position and can rotate about the x axis, y axis and z axis with forces that depend on the shape of pivot 2301. In addition, since board 2330 and pivot 2301 rotate separately from base 2320, the amount of rotation of pivot 2301 and board 2330 about axis x will differ from the other embodiments.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments. Thus, for example, a balance board within the scope of this patent may have any of the aspects of the mechanism connecting board and base described herein. Thus, for example and without limitation, the various embodiments of pivots, boards, bases, and rings described herein may be combined to form one of numerous balance board embodiments, and any of the pivots attached to the board may include a smooth distal end to permit using the board without the base.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention. Thus, for example, only certain portions of the pivot may exhibit the described degrees of rotational symmetry.

I claim:

1. An exercise apparatus for a user, said exercise apparatus comprising:

a base for placing on the ground, where the base has a base axis that is perpendicular to the ground;

a board including a platform for accepting a body part of the user, where the board has a board axis that is perpendicular to the platform; and a pivot disposed between, and in contact with, said base and said board, where said board has a neutral position relative to said base wherein said pivot does not impart a rotational force on said board about said board axis, where, when said board is rotated about said board axis away from said neutral position, said pivot imparts a torque on said board about said board axis, where said pivot is affixed to neither said base nor said board and has a base portion and a board portion, where said pivot has a pivot axis extending through s-said base portion and said board portion, where said base includes a support configured to slidably contact a surface of said base portion of said pivot, where said board includes a support configured to slidably contact a surface of said board portion of said pivot, where said base includes three supports equally spaced about said base axis, where said board includes three supports equally spaced about said board axis, and where at least part of said base portion of said pivot and said board portion of said pivot has three-fold symmetry about said pivot axis.

2. The exercise device of claim 1, where said pivot has mid-plane between said base portion and said board portion, and where the base portion of said pivot is a mirror image of said board portion of said pivot about said mid-plane.

3. An exercise apparatus for a user, said exercise apparatus comprising:

a base for placing on the ground, where the base has a base axis that is perpendicular to the ground;

a board including a platform for accepting a body part of the user, where the board has a board axis that is perpendicular to the platform; and a pivot disposed between, and in contact with, said base and said board, and having slidable contact with at least one of said base or said board;

where said pivot has three-fold symmetry in an axis between said base and said board and where points of slidable contact between said pivot and said at least one of said base or said board has three-fold symmetry, where said pivot is affixed to neither said base nor said board and has a base portion and a board portion, where said pivot has a pivot axis extending through said base portion and said board portion, where said base includes a support configured to provide slidably contact a surface of said base portion of said pivot, where said board includes a support configured to slidably contact a surface of said board portion of said pivot, where said base includes three supports equally spaced about said base axis, where said board includes three supports equally spaced about said board axis, and where at least part of said base portion of said pivot and said board portion of said pivot has three-fold symmetry about said pivot axis.

4. The exercise device of claim 3, where said pivot has mid-plane between said base portion and said board portion, and where the base portion of said pivot is a mirror image of said board portion of said pivot about said mid-plane.

* * * * *